US010392733B2

(12) United States Patent
Jiang et al.

(10) Patent No.: US 10,392,733 B2
(45) Date of Patent: Aug. 27, 2019

(54) JACQUARD WARP TENSION DEVICE FOR WARP KNITTING MACHINE

(71) Applicant: JIANGNAN UNIVERSITY, Wuxi, Jiangsu (CN)

(72) Inventors: Gaoming Jiang, Jiangsu (CN); Honglian Cong, Jiangsu (CN); Fenglin Xia, Jiangsu (CN); Qi Zhang, Jiangsu (CN); Jisheng Zhang, Jiangsu (CN)

(73) Assignee: JIANGNAN UNIVERSITY, Wuxi, Jiangsu (CN)

( * ) Notice: Subject to any disclaimer, the term of this patent is extended or adjusted under 35 U.S.C. 154(b) by 52 days.

(21) Appl. No.: 15/551,157

(22) PCT Filed: Dec. 18, 2015

(86) PCT No.: PCT/CN2015/097900
§ 371 (c)(1),
(2) Date: Aug. 15, 2017

(87) PCT Pub. No.: WO2017/067050
PCT Pub. Date: Apr. 27, 2017

(65) Prior Publication Data

US 2018/0023228 A1 Jan. 25, 2018

(30) Foreign Application Priority Data

Oct. 20, 2015 (CN) ..... 2015 1 0683070

(51) Int. Cl.
*D04B 27/12* (2006.01)
*D04B 21/06* (2006.01)

(52) U.S. Cl.
CPC ..... *D04B 27/12* (2013.01); *D04B 21/06* (2013.01)

(58) Field of Classification Search
CPC ..... D04B 27/12; D04B 27/14; D04B 27/18; D04B 27/20; D04B 27/22
See application file for complete search history.

(56) References Cited

U.S. PATENT DOCUMENTS 2,505,372 A * 4/1950 Te Strake ..... D04B 23/02 66/87
3,749,136 A * 7/1973 Robinson ..... D03D 49/06 139/109

(Continued)

FOREIGN PATENT DOCUMENTS

CN 102108599 A 6/2011
CN 202064131 U 12/2011

(Continued)

OTHER PUBLICATIONS

English version of the First Chinese Office Action Appln. No. 201510683070.6.

(Continued)

*Primary Examiner* — Danny Worrell
*Assistant Examiner* — Larry D Worrell, Jr.
(74) *Attorney, Agent, or Firm* — Ladas & Parry LLP

(57) ABSTRACT

A jacquard warp tensioning device for a warp knitting machine, comprising a pair of side panels (1) disposed on two sides of the machine casing, a warp beam (2) positioned at the upper portions of the side panels (1), a plurality of warp guide rods (3, 4, 5) disposed at positions lower than that of the warp beam (2) and a flat spring warp dividing device (16), wherein an upper tension balancing device (6) and a lower tension balancing device (11) are disposed between the warp beam (2) and the warp guide rods (3, 4, 5), the upper tension balancing device (6) comprising an upper rotating shaft (7) with two ends thereof disposed on the side panels (1), an upper servo motor (8) disposed at one end of the upper rotating shaft (7) and an upper tensioning rod (9)

(Continued)

fixedly disposed on the upper rotating shaft (7) by means of a plurality of upper connecting rods (10), the lower tension balancing device (11) comprising a lower rotating shaft (12) with two ends thereof disposed on the side panels (1), a lower servo motor (13) disposed at one end of the lower rotating shaft (12) and a lower tensioning rod (14) fixedly disposed on the lower rotating shaft (12) by means of a plurality of lower connecting rods (15), the upper servo motor (8) and the lower servo motor (13) being connected with an industrial computer (17) through a servo driver (19), respectively. The jacquard warp tensioning device proactively controls warp tension and has a high level tension compensation, thereby making the yarns not prone to being broken and enabling smooth surfaces of woven fabrics.

4 Claims, 2 Drawing Sheets

(56) References Cited

U.S. PATENT DOCUMENTS

| | | | | |
|---|---|---|---|---|
| 3,854,306 A | | 12/1974 | Heywood et al. | |
| 4,020,654 A | | 5/1977 | Gajjar | |
| 4,069,690 A | * | 1/1978 | Smith | D04B 11/18 66/135 |
| 4,235,083 A | | 11/1980 | Dale et al. | |
| 4,382,371 A | | 5/1983 | Dale et al. | |
| 5,699,681 A | | 12/1997 | Nittmann | |

FOREIGN PATENT DOCUMENTS

| | | |
|---|---|---|
| CN | 203807701 U | 9/2014 |
| CN | 203890622 U | 10/2014 |
| CN | 204023135 U | 12/2014 |
| CN | 104862877 A | 8/2015 |
| EP | 1520922 A | 4/2005 |
| JP | 62-069863 A | 3/1987 |

OTHER PUBLICATIONS

The International Search Report dated Jul. 8, 2016, PCT/CN2015/097900.

* cited by examiner

JACQUARD WARP TENSION DEVICE FOR WARP KNITTING MACHINE

FIELD

The present invention relates to a warp knitting machine and, more particularly, to a warp knitting machine with a jacquard warp tensioning device.

BACKGROUND

During production of warp knitted jacquard fabrics, jacquard pattern designs are achieved by means of thick and thin fabric textures, and the amounts of yarns used by thick and thin fabric textures differ considerably, thus resulting in uneven warp tension in different areas during weaving process. A jacquard warp tensioning device of a presently used warp knitting machine comprises a pair of parallel side panels disposed on two sides of the machine casing, a warp beam, a plurality of warp guide rods and a flat spring warp dividing device—all disposed between the pair of side panels, the warp beam being positioned at the upper portions of the two side panels, the plurality of warp guide rods and the flat spring warp dividing device being disposed successively at positions lower than that of the warp beam, the flat spring warp dividing device comprising a plurality of flat springs. Yarns are fed to the warp knitting machine by the warp beam and the warp beam is wound up with a large number of parallelly arranged warp yarns, and after being conveyed from the warp beam, the warp yarns first revolve round the plurality of warp guide rods and then pass through the flat spring warp dividing device, so that the warp yarns move longitudinally forward in a Z-shape. When the designed pattern is large, the warp tensions at the areas where thick textures are woven tend to be too high, the flat springs bend downwards to prevent tension excessiveness, and the warp tensions at the areas where thin textures are woven tend to be too low, the flat springs upwardly spring back to prevent tension inadequacy. However, since the extent of bending and the extent of springback are limited, tension compensation level is low and this results in an increased yarn breakage ratio and a low weaving efficiency. In addition, surfaces of the farbrics produced are uneven due to tension imbalance.

SUMMARY OF THE INVENTION

To overcome the deficiency existing in the prior art, the present invention aims to resolve the technical problems by providing a warp knitting machine with a jacquard warp tensioning device that has a high level tension compensation, thereby making the yarns not prone to being broken and enabling smooth surfaces of woven fabrics.

To this end, the warp knitting machine with a jacquard warp tensioning device of the present invention comprises a pair of parallel side panels disposed on two sides of the machine casing, a warp beam, a plurality of warp guide rods and a flat spring warp dividing device—all disposed between the pair of side panels, the warp beam being positioned at the upper portions of the side panels, the plurality of warp guide rods and the flat spring warp dividing device being disposed successively at positions lower than that of the warp beam, wherein an upper tension balancing device and a lower tension balancing device are disposed between the warp beam and the plurality of warp guide rods, the upper tension balancing device comprising an upper rotating shaft with two ends thereof disposed on the side panels, an upper servo motor disposed at one end of the upper rotating shaft and an upper tensioning rod fixedly disposed on the upper rotating shaft by means of a plurality of upper connecting rods, the upper tensioning rod corresponding to the upwardly conveyed yarns of the warp yarns; the lower tension balancing device comprising a lower rotating shaft with two ends thereof disposed on the side panels, a lower servo motor disposed at one end of the lower rotating shaft and a lower tensioning rod fixedly disposed on the lower rotating shaft by means of a plurality of lower connecting rods, the lower tensioning rod corresponding to the downwardly conveyed yarns of the warp yarns; the upper servo motor and the lower servo motor being connected with an industrial computer through a servo driver, respectively.

The provision of an upper tension balancing device and a lower tension balancing device enables proactive control of warp tension and a high level tension compensation, thereby making the yarns not prone to being broken and resolving difficulties associated with the production of highly figured jacquard fabrics.

Further, the number of warp guide rods is three including an upper warp guide rod, a middle warp guide rod and a lower warp guide rod.

Further, the flat spring warp dividing device comprises two groups of flat spring warp dividing devices for upwardly conveyed yarns and flat spring warp dividing devices for downwardly conveyed yarns installed alongside each other on the side panel, the flat spring warp dividing devices for upwardly conveyed yarns corresponding to the upwardly conveyed yarns, the flat spring warp dividing devices for downwardly conveyed yarns corresponding to the downwardly conveyed yarns, the upwardly conveyed yarns and the downwardly conveyed yarns successively passing through the flat spring warp dividing devices for upwardly conveyed yarns and the flat spring warp dividing devices for downwardly conveyed yarns respectively, the curved side of the flat spring warp dividing device for upwardly conveyed yarns being provided with a tension excessiveness sensor for upwardly conveyed yarns and the springback side thereof being provided with a tension inadequacy sensor for upwardly conveyed yarns, the curved side of the flat spring warp dividing devices for downwardly conveyed yarns being provided with a tension excessiveness sensor for downwardly conveyed yarns and the springback side thereof being provided with a tension inadequacy sensor for downwardly conveyed yarns; the tension excessiveness sensor for upwardly conveyed yarns, the tension inadequacy sensor for upwardly conveyed yarns, the tension excessiveness sensor for downwardly conveyed yarns and the tension inadequacy sensor for downwardly conveyed yarns are connected with the industrial computer, respectively.

Further, the tension excessiveness sensor for upwardly conveyed yarns, the tension inadequacy sensor for upwardly conveyed yarns, the tension excessiveness sensor for downwardly conveyed yarns and the tension inadequacy sensor for downwardly conveyed yarns are metallic strain gauge sensors installed respectively on the side panels.

The provision of two groups of flat spring warp dividing devices and the installation of sensors at two sides of each group of flat spring warp dividing devices enable detection of tensions of the upwardly conveyed yarns and the downwardly conveyed yarns respectively to be fed back to the industrial computer to achieve closed-loop control and compensate for errors, so that warp tension compensation is more precise and balanced, and the surfaces of woven fabrics are even.

The present invention has the following advantages:

1. The jacquard warp tensioning device proactively controls warp tension and has a high level tension compensation, thereby making the yarns not prone to being broken.
2. As the warp tension is balanced during the weaving cycle, smooth surfaces of woven fabrics are enabled.

Figure 1:
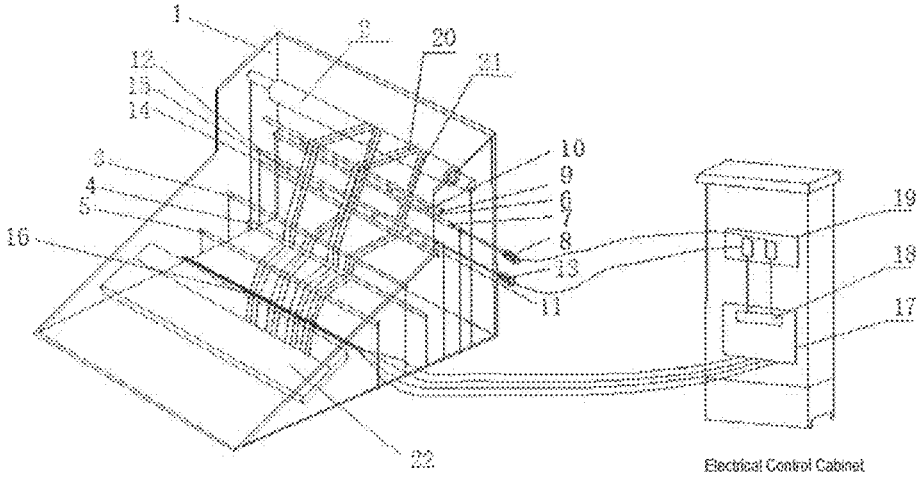
FIG. 1 is an isometric schematic view of a jacquard warp tensioning device for a warp knitting machine.
Figure 2:
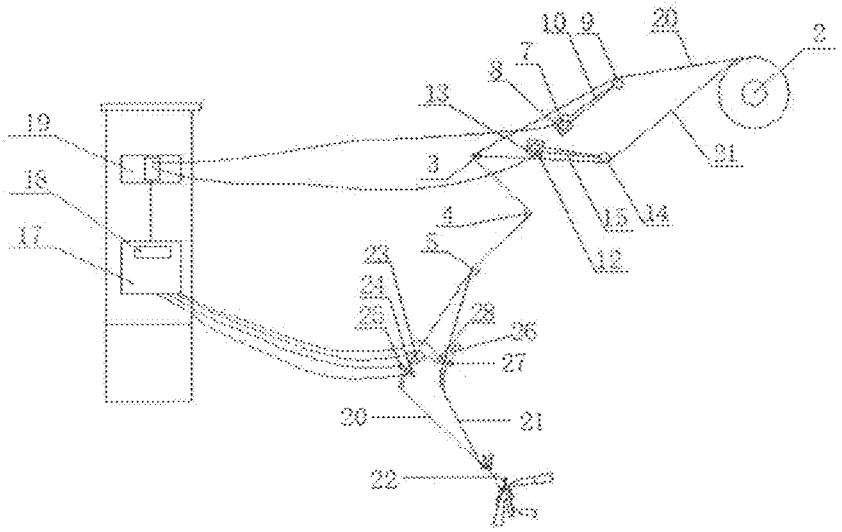
FIG. 2 is a schematic side elevation of a jacquard warp tensioning device for a warp knitting machine.
Figure 3:
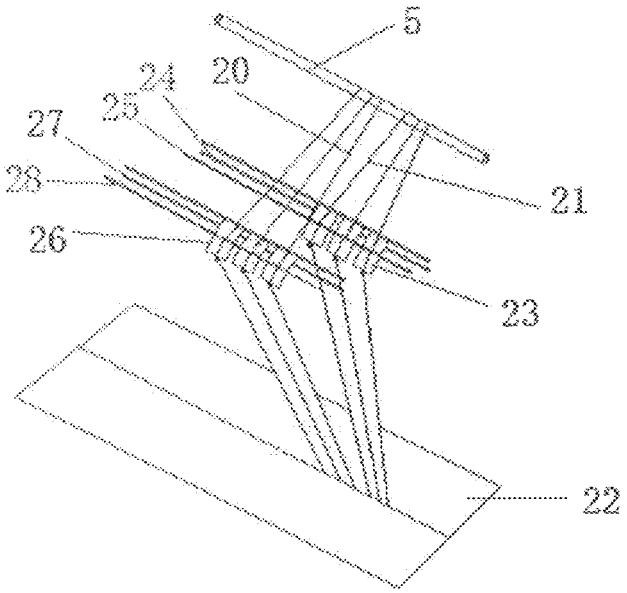
FIG. 3 is a schematic view illustrating the yarn conveying directions of a group of upwardly conveyed yarns and a group of downwardly conveyed yarns from a lower warp guide rod to the weaving area.

In the figures, 1 denotes side panel; 2 denotes warp beam; 3 denotes upper warp guide rod; 4 denotes middle warp guide rod; 5 denotes lower warp guide rod; 6 denotes upper tension balancing device; 7 denotes upper rotating shaft; 8 denotes upper servo motor; 9 denotes upper tensioning rod; 10 denotes upper connecting rod; 11 denotes lower tension balancing device; 12 denotes lower rotating shaft; 13 denotes lower servo motor; 14 denotes lower tensioning rod; 15 denotes lower connecting rod; 16 denotes flat spring warp dividing device; 17 denotes industrial computer; 18 denotes motion control card; 19 denotes servo driver; 20 denotes upwardly conveyed yarns; 21 denotes downwardly conveyed yarns; 22 denotes weaving area; 23 denotes flat spring warp dividing device for upwardly conveyed yarns; 24 denotes tension excessiveness sensor for upwardly conveyed yarns; 25 denotes tension inadequacy sensor for upwardly conveyed yarns; 26 denotes flat spring warp dividing device for downwardly conveyed yarns; 27 denotes tension excessiveness sensor for downwardly conveyed yarns; and 28 denotes tension inadequacy sensor for downwardly conveyed yarns.

DETAILED DESCRIPTION

The present invention is described in further detail below with reference to preferred embodiments thereof in combination with the accompanying drawings.

A jacquard warp tensioning device for a warp knitting machine of the present invention comprises a pair of parallel side panels (1) disposed on two sides of the machine casing, and a warp beam (2), an upper warp guide rod (3), a middle warp guide rod (4), a lower warp guide rod (5) and a flat spring warp dividing device (16)—all disposed between the pair of side panels (1), the warp beam (2) being positioned at the upper portions of the side panels (1), the upper warp guide rod (3), the middle warp guide rod (4), the lower warp guide rod (5) and the flat spring warp dividing device (16) being disposed successively at positions lower than that of the warp beam (2), wherein an upper tension balancing device (6) and a lower tension balancing device (11) are disposed between the warp beam (2) and the plurality of warp guide rods, the upper tension balancing device (6) comprising an upper rotating shaft (7) with two ends thereof disposed on the side panels (1), an upper servo motor (8) disposed at one end of the upper rotating shaft (7) and an upper tensioning rod (9) fixedly disposed on the upper rotating shaft (7) by means of a plurality of upper connecting rods (10), the upper tensioning rod (9) corresponding to the upwardly conveyed yarns (20) of the warp yarns; the lower tension balancing device (11) comprising a lower rotating shaft (12) with two ends thereof disposed on the side panels (1), a lower servo motor (13) disposed at one end of the lower rotating shaft (12) and a lower tensioning rod (14) fixedly disposed on the lower rotating shaft (12) by means of a plurality of lower connecting rods (15), the lower tensioning rod (14) corresponding to the downwardly conveyed yarns (21) of the warp yarns.

The flat spring warp dividing device (16) comprises two groups of flat spring warp dividing devices for upwardly conveyed yarns (23) and flat spring warp dividing devices for downwardly conveyed yarns (26) installed alongside each other on the side panel (1), the flat spring warp dividing devices for upwardly conveyed yarns (23) corresponding to the upwardly conveyed yarns (20), the flat spring warp dividing devices for downwardly conveyed yarns (26) corresponding to the downwardly conveyed yarns (21), the horizontal plane on which the flat spring warp dividing devices for downwardly conveyed yarns (26) are located being slightly lower than the horizontal plane on which the flat spring warp dividing devices for upwardly conveyed yarns (23) are located to facilitate the passing through by warp yarns. The upwardly conveyed yarns (20) and the downwardly conveyed yarns (21) successively pass through the flat spring warp dividing devices for upwardly conveyed yarns (23) and the flat spring warp dividing devices for downwardly conveyed yarns (26) respectively, the curved side of the flat spring warp dividing device for upwardly conveyed yarns (23) is provided with a tension excessiveness sensor for upwardly conveyed yarns (24) and the springback side thereof is provided with a tension inadequacy sensor for upwardly conveyed yarns (25), the curved side of the flat spring warp dividing devices for downwardly conveyed yarns (26) is provided with a tension excessiveness sensor for downwardly conveyed yarns (27) and the springback side thereof is provided with a tension inadequacy sensor for downwardly conveyed yarns (28); the tension excessiveness sensor for upwardly conveyed yarns (24), the tension inadequacy sensor for upwardly conveyed yarns (25), the tension excessiveness sensor for downwardly conveyed yarns (27) and the tension inadequacy sensor for downwardly conveyed yarns (28) are connected with the industrial computer (17), respectively. The tension excessiveness sensor for upwardly conveyed yarns (24), the tension inadequacy sensor for upwardly conveyed yarns (25), the tension excessiveness sensor for downwardly conveyed yarns (27) and the tension inadequacy sensor for downwardly conveyed yarns (28) are metallic strain gauge sensors installed respectively on the side panels (1).

Yarns are fed to the warp knitting machine by the warp beam (2) and the warp beam (2) is wound up with a large number of parallelly arranged warp yarns. The warp knitting machine conveys warp yarns in a proactive manner and maintains a constant warp conveying rate of the warp beam (2). Referring to the jacquard texture distribution diagram shown in FIG. 4, the warp yarns conveyed from the warp beam (2) are divided into upward yarn routings and downward yarn routings alternately arranged, the upward yarn routings are referred to as upwardly conveyed yarns (20) and the downward yarn routings are referred to as downwardly conveyed yarns (21). The upwardly conveyed yarns (20) first successively revolve round the upper tensioning rod (9), the upper warp guide rod (3), the middle warp guide rod (4), the lower warp guide rod (5) and then pass through the flat spring warp dividing devices for upwardly conveyed yarns (23) so that the warp yarns move longitudinally forward in a Z-shape. The downwardly conveyed yarns (21) first successively revolve round the lower tensioning rod (14), the upper warp guide rod (3), the middle warp guide rod (4), the lower warp guide rod (5) and then pass through the flat spring warp dividing devices for downwardly conveyed yarns (26) so that the warp yarns move longitudinally forward in a Z-shape.

Before weaving, the industrial computer (17) reads documents of jacquard pattern technical information, including jacquard offset information which is a digital form of jacquard texture diagram, and pattern height and breadth information. The industrial computer (17) analyses the amounts of warp let-off of the upwardly conveyed yarns (20) and the downwardly conveyed yarns (21) based on jacquard pattern technical information, and transmits the amounts of warp let-off required by the warp yarns on the two paths in a digital manner to a motion control card (18) in the industrial computer (17), and the motion control card (18) then converts the digital signals to analog signals by means of a digital to analog converter and outputs pulse signals to a servo driver (19). Adopting a speed control mode and based on the number and frequency of pulses, the servo driver (19) regulates the rotational directions and rotational speeds of the upper servo motor (8) and the lower servo motor (13) so that the upper rotating shaft (7) and the lower rotating shaft (12) propel the upper tensioning rod (9) and the lower tensioning rod (14) to swing upwards or downwards, thereby storing or releasing warp yarns to accomplish the function of regulating jacquard woven warp tension.

Figure 4:
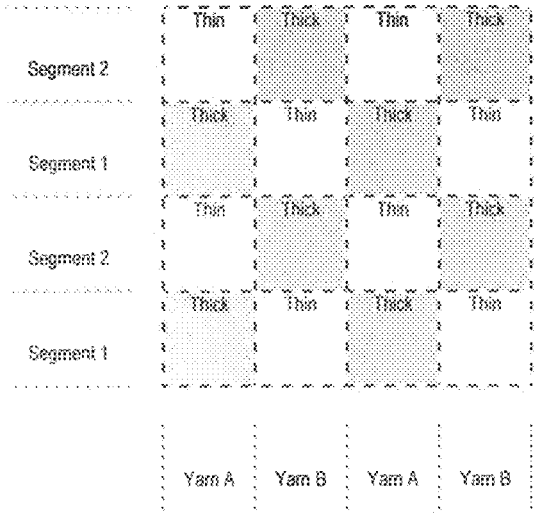
FIG. 4 is a jacquard texture distribution diagram.

Referring to the jacquard texture distribution diagram shown in FIG. 4, during the weaving of segment 1, the amounts of yarns used by the upwardly conveyed yarns (20) are greater than the amounts of yarns conveyed by the warp beam (2), the upper rotating shaft (7) propels the upper tensioning rod (9) to swing downwards and the warp yarns already stored are released by the upwardly conveyed yarns (20) to prevent increase in warp tension; whereas the amounts of yarns used by the downwardly conveyed yarns (21) are smaller than the amounts of yarns conveyed by the warp beam (2), the lower rotating shaft (12) propels the lower tensioning rod (14) to swing downwards at the same time and the redundant warp yarns are stored by the downwardly conveyed yarns (21) to prevent decrease in warp tension. Upon entering the weaving process of segment 2, the amounts of the upwardly conveyed yarns (20) used become smaller than the amounts of yarns conveyed by the warp beam (2), and the amounts of the downwardly conveyed yarns (21) used are greater than the amounts of yarns conveyed by the warp beam (2), the upper rotating shaft (7) propels the upper tensioning rod (9) to swing upwards to store the redundant warp yarns to prevent decrease in warp tension; the lower rotating shaft (12) propels the lower tensioning rod (14) to swing upwards at the same time and the downwardly conveyed yarns (21) stored in segment 1 are released to prevent increase in warp tension. Through storage and release of warp yarns, the tension fluctuations of the upwardly conveyed yarns (20) and the downwardly conveyed yarns (21) during the weaving process are greatly reduced, by which time a weaving cycle is completed and weaving of segment 1 is then reentered.

As a further improvement by the present invention, when the warp tension is too low or too high, the warp yarns become in contact with metal bars of the sensors and the metal bars undergo stress variation, causing deformation of the electrical resistance strain gauges adhered to the metal bars and variation of the resistances of the electrical resistance strain gauges, thereby varying the voltages of the electrical resistance strain gauges and the variations are amplified by means of instrumentation amplifiers. Analog signals are converted to digital signals by means of an analog to digital converter, the digital signals are transmitted to the industrial computer (17). The industrial computer (17) analyses the amounts of warp let-off of the upwardly conveyed yarns (20) or those of the downwardly conveyed yarns (21) based on jacquard pattern technical information, and transmits the amounts of warp let-off required by the warp yarns on the two paths in a digital manner to a motion control card (18) in the industrial computer (17), and the motion control card (18) then converts the digital signals to analog signals by means of a digital-to-analog converter and outputs pulse signals to a servo driver (19). Adopting a speed control mode and based on the number and frequency of pulses, the servo driver (19) regulates the rotational directions and rotational speeds of the upper servo motor (8) and the lower servo motor (13), thereby regulating the rotational directions and rotational speeds of the upper tensioning rod (9) or those of the lower tensioning rod (14).

During weaving of segment 1, when the flat spring warp dividing devices for upwardly conveyed yarns (23) become in contact with the tension excessiveness sensor for upwardly conveyed yarns (24) or when the flat spring warp dividing devices for downwardly conveyed yarns (26) become in contact with the tension inadequacy sensor for downwardly conveyed yarns (28), the industrial computer (17) reduces the rotational speed of the upper servo motor (8) or that of the lower servo motor (13) by means of the servo driver (19) to thereby reduce the rotational speed of the upper tensioning rod (9) or that of the lower tensioning rod (14); when the flat spring warp dividing devices for upwardly conveyed yarns (23) become in contact with the tension inadequacy sensor for upwardly conveyed yarns (25) or when the flat spring warp dividing devices for downwardly conveyed yarns (26) become in contact with the tension excessiveness sensor for downwardly conveyed yarns (27), the industrial computer (17) increases the rotational speed of the upper servo motor (8) or that of the lower servo motor (13) by means of the servo driver (19) to thereby increase the rotational speed of the upper tensioning rod (9) or that of the lower tensioning rod (14). During weaving of segment 2, when the the flat spring warp dividing devices for upwardly conveyed yarns (23) become in contact with the tension inadequacy sensor for upwardly conveyed yarns (25) or when the flat spring warp dividing devices for downwardly conveyed yarns (26) become in contact with the tension excessiveness sensor for downwardly conveyed yarns (27), the industrial computer (17) reduces the rotational speed of the upper servo motor (8) or that of the lower servo motor (13) by means of the servo driver (19) to thereby reduce the rotational speed of the upper tensioning rod (9) or that of the lower tensioning rod (14); when the flat spring warp dividing devices for upwardly conveyed yarns (23) become in contact with the tension excessiveness sensor for upwardly conveyed yarns (24) or when the flat spring warp dividing devices for downwardly conveyed yarns (26) become in contact with the tension inadequacy sensor for downwardly conveyed yarns (28), the industrial computer (17) increases the the rotational speed of the upper servo motor (8) or that of the lower servo motor (13) by means of the servo driver (19) to thereby increase the rotational speed of the upper tensioning rod (9) or that of the lower tensioning rod (14). In this way, the errors existing during the warp conveying process are compensated through correction by the closed-loop system.

While the foregoing illustrates in detail preferred manners of implementation and preferred embodiments of the present invention with reference to the accompanying drawings, the present invention is not limited to the aforementioned manners of implementation and embodiments, and persons skilled in the art will be able to make different alterations without departing from the spirit of the present invention and these equivalent forms shall fall within the scope of the present invention as specifically set forth in the claims appended hereto.

What is claimed is:

1. A jacquard warp tensioning device for a warp knitting machine, comprising:

a pair of parallel side panels disposed on two sides of a machine casing a warp beam, a plurality of warp guide rods and a flat spring warp dividing device—all disposed between the pair of side panels, the warp beam being positioned at upper portions of the side panels, the plurality of warp guide rods and the flat spring warp dividing device being disposed successively at positions lower than that of the warp beam, wherein an upper tension balancing device and a lower tension balancing device are disposed between the warp beam and the plurality of warp guide rods, the upper tension balancing device comprising an upper rotating shaft with two ends thereof disposed on the side panels, an upper servo motor disposed at one end of the upper rotating shaft and an upper tensioning rod fixedly disposed on the upper rotating shaft by a plurality of upper connecting rods, the upper tensioning rod corresponding to upwardly conveyed yarns of the warp yarns; the lower tension balancing device comprising a lower rotating shaft with two ends thereof disposed on the side panels, a lower servo motor disposed at one end of the lower rotating shaft and a lower tensioning rod fixedly disposed on the lower rotating shaft by of a plurality of lower connecting rods, the lower tensioning rod corresponding to downwardly conveyed yarns of the warp yarns; the upper servo motor and the lower servo motor being connected with an industrial computer through a servo driver, respectively.

2. The jacquard warp tensioning device for a warp knitting machine as defined in claim 1, wherein the number of warp guide rods is three including an upper warp guide rod, a middle warp guide rod and a lower warp guide rod.

3. The jacquard warp tensioning device for a warp knitting machine as defined in claim 1 or 2, wherein the flat spring warp dividing device comprises two groups of flat spring warp dividing devices for upwardly conveyed yarns and flat spring warp dividing devices for downwardly conveyed yarns installed alongside each other on the side panel, the flat spring warp dividing devices for upwardly conveyed yarns corresponding to the upwardly conveyed yarns, the flat spring warp dividing devices for downwardly conveyed yarns corresponding to the downwardly conveyed yarns, the upwardly conveyed yarns and the downwardly conveyed yarns successively passing through the flat spring warp dividing devices for upwardly conveyed yarns and the flat spring warp dividing devices for downwardly conveyed yarns respectively, the curved side of the flat spring warp dividing device for upwardly conveyed yarns being provided with a tension excessiveness sensor for upwardly conveyed yarns and a springback side thereof being provided with a tension inadequacy sensor for upwardly conveyed yarns, the curved side of the flat spring warp dividing devices for downwardly conveyed yarns being provided with a tension excessiveness sensor for downwardly conveyed yarns and a springback side thereof being provided with a tension inadequacy sensor for downwardly conveyed yarns, the tension excessiveness sensor for upwardly conveyed yarns, the tension inadequacy sensor for upwardly conveyed yarns, the tension excessiveness sensor for downwardly conveyed yarns and the tension inadequacy sensor for downwardly conveyed yarns being connected with the industrial computer, respectively.

4. The jacquard warp tensioning device for a warp knitting machine as defined in claim 3, wherein the tension excessiveness sensor for upwardly conveyed yarns, the tension inadequacy sensor for upwardly conveyed yarns, the tension excessiveness sensor for downwardly conveyed yarns and the tension inadequacy sensor for downwardly conveyed yarns are metallic strain gauge sensors installed respectively on the side panels.

* * * * *